United States Patent [19]

Stark

[11] 4,373,330

[45] Feb. 15, 1983

[54] DIESEL ENGINE DUAL PATH EXHAUST CLEANER AND BURNER SYSTEM

[75] Inventor: Terrence L. Stark, Washington, Mich.

[73] Assignee: General Motors Corporation, Detroit, Mich.

[21] Appl. No.: 278,088

[22] Filed: Jun. 29, 1981

[51] Int. Cl.[3] ..... F01N 3/02

[52] U.S. Cl. ..... 60/311; 55/284; 55/350; 55/466; 55/DIG. 30; 60/295; 60/296; 60/300; 60/303

[58] Field of Search ..... 60/295, 296, 300, 303, 60/311; 55/DIG. 30, 273, 283, 284, 523, 350, 466

[56] References Cited

U.S. PATENT DOCUMENTS

| | | | |
|---|---|---|---|
| 2,898,202 | 8/1959 | Houdry | 60/296 |
| 4,167,852 | 9/1979 | Ludecke | 60/296 |
| 4,217,757 | 8/1980 | Crone, Jr. | 60/288 |
| 4,281,512 | 8/1981 | Mills | 55/523 |
| 4,335,574 | 6/1982 | Sato | 60/311 |
| 4,345,431 | 8/1982 | Suzuki | 60/286 |

FOREIGN PATENT DOCUMENTS

| | | | |
|---|---|---|---|
| 2655932 | 6/1978 | Fed. Rep. of Germany | 60/295 |

*Primary Examiner*—Douglas Hart
*Attorney, Agent, or Firm*—Arthur N. Krein

[57] ABSTRACT

A dual filter element exhaust cleaner and burner system for diesel engines provides for the trapping of particulates in the engine exhaust gases by their passage through filter elements, as selectively controlled by means of a four-way valve. Collected particulates in a non-active particulate filter element are incinerated by means of a heater, with this filter element, during incineration, being supplied with exhaust gases through a constant flow exhaust gas regulator whereby incineration of the particulates will occur at a controlled rate independent of engine speed.

3 Claims, 5 Drawing Figures

DIESEL ENGINE DUAL PATH EXHAUST CLEANER AND BURNER SYSTEM

BACKGROUND OF THE INVENTION

This invention relates to diesel engine exhaust treatment systems, and, in particular, to a dual path exhaust cleaner and burner system for collecting and then incinerating particulates discharged in the exhaust gases from a diesel engine.

DESCRIPTION OF THE PRIOR ART

It is known in the art to provide a diesel engine with an exhaust treatment system that includes one or more particulate traps or filters that are operative to filter out and collect particulates from the exhaust gas stream discharged from the engine. Such particulates consists largely of carbon particles that tend to plug the filter, thus restricting exhaust gas flow therethrough. Accordingly, after continued use of such a system for a period of time dependent on engine operation, it becomes desirable to effect regeneration of the particulate filter. Restoration of such a particulate filter has been accomplished by the use of a suitable auxiliary burner device. For example, an air-fuel nozzle and an ignition device can be used and operated, when desired, to heat the exhaust gases and the particulate filter to the combustion temperature of the collected particulates so as to burn them off the filter surfaces and, accordingly, to thus reopen the flow paths therethrough to again permit normal flow of the exhaust gases through that filter. Alternatively, an electric heater means can be used to generate the additional heat required to initiate the combustion of the trapped particulates.

However, during the incineration of accumulated particulates on a filter, the uncontrolled burning thereof can result in excessively high temperatures. Such high temperatures, if not evenly distributed throughout the body of the filter, can result in thermal gradients which may cause mechanical failure of the filter structure or, even worse, such high temperatures may actually exceed the melting temperatures of the material used to fabricate the filter.

SUMMARY OF THE INVENTION

Accordingly, a primary object of the invention is to provide an improved dual path exhaust cleaner and burner system for use with a diesel engine that advantageously utilizes a four-way valve controlled passage means and a constant flow regulator whereby a portion of the exhaust flow from the engine can be used to control the incineration of particulates collected on one of the filters while the remainder of the exhaust gases can flow through the other filter to be cleaned thereby.

Another object of the invention is to provide an improved dual path exhaust cleaner and burner system having a constant flow regulator arranged therein whereby to control the flow of exhaust gases to an inactive filter so as to effect the controlled incineration of particulates trapped thereon.

For a better understanding of the invention, as well as other objects and further features thereof, reference is had to the following detailed description of the invention to be read in connection with the accompanying drawings.

DESCRIPTION OF THE FIRST EMBODIMENT

Figure 1:
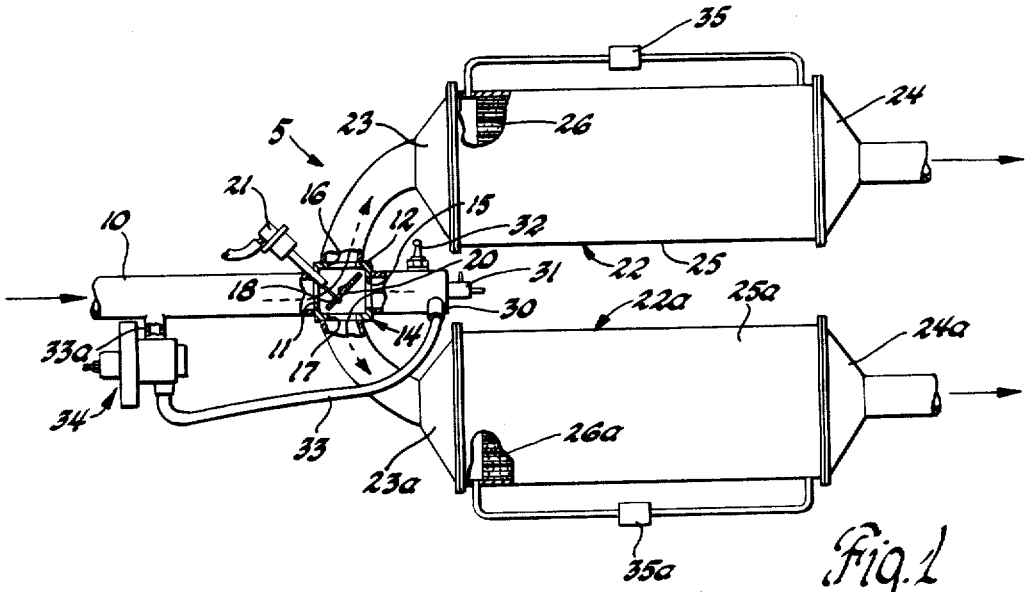
FIG. 1 is a schematic view of a first embodiment of a dual element exhaust cleaner and burner system in accordance with the invention for use with a diesel engine, with parts broken away to show various details of the system.

Referring first to FIG. 1, there is schematically illustrated a dual path exhaust cleaner and burner system, generally designated 5, for use with a diesel engine, not shown. This system 5 includes an exhaust duct 10, one end, the left end with reference to FIG. 1, of which is adapted to receive the exhaust gases from a diesel engine, with the opposite end of this exhaust duct being connected to a first inlet 11 in the valve housing 12 of a four-way valve 14.

As shown, the housing 12 of the four-way valve 14 also includes a second inlet 15 located opposite inlet 11 and, first and second outlets 16 and 17, respectively, that are located opposite to each other and positioned intermediate the inlets 11 and 15. A valve member 18, fixed in a conventional manner to a valve shaft 20 suitably journaled in the valve housing 12, is movable between a first position flow interconnecting the inlet 11 with outlet 16 and the inlet 15 with outlet 17 and, a second position interconnecting inlet 11 for flow communication with outlet 17 and for connecting inlet 15 in flow communication with outlet 16.

It will be appreciated that with this arrangement the valve member 18 can also be moved, if desired, to an intermediate or neutral position between the above-described first and second positions a position at which the valve member 18 would be centered so as to permit inlet 11 to be in flow communication with both outlets 16 and 17. A suitable actuator, such as a vacuum actuator 21, is operatively connected to the valve shaft 20 to effect the desired pivotable movement of the valve member 18. Preferably, as schematically shown in FIG. 1, the vacuum actuator 21 is a conventional two-position actuator to effect selective movement of the valve member 18 to the first two positions described hereinabove. The vacuum fitting of this actuator is adapted to be selectively connected to either a suitable source of vacuum or to the atmosphere, as controlled by suitable three-way solenoid valve, not shown. The solenoid valve, not shown, would in turn be actuated by means of a conventional electronic control means, not shown, in a manner to be described.

A pair of cleaner members 22 and 22*a*, each having intake and discharge sections 23 and 24, respectively, are connected at their associate intake ends 23 to the outlets 16 and 17, respectively of the valve 14. The discharge sections 24 of the cleaner members 22 and 22*a* are adapted to discharge exhaust gases directly to the atmosphere or, if desired that can be connected to conventional exhaust pipes, not shown.

Intermediate the intake and discharge sections 23 and 24, respectively, each cleaner member 22 and 22a is provided with a respective housing portion 25, 25a. These housing portions 25, 25a are of suitable configuration whereby to support an associate particulate filter 26 or 26a, respectively, therein for flow communication with the associate intake section 23 and outlet section 24 at opposite ends thereof.

The particulate filters 26, 26a may be of any material and construction suitable for use in a diesel engine exhaust system to collect particulates and other combustibles present in the stream of exhaust gas discharged from the engine and which may subsequently be heated to the combustion temperature of the particulates whereby to permit the incineration of these particulates so that the filters may be regenerated. Suitable materials may include, for example, ceramic beads or monolithic ceramic structures similar to those currently used as catalyst support means in exhaust catalytic converters presently used in many gasoline fueled automobile engines. Alternately, for example, metal wire mesh or multiple screen elements may also provide suitable filter element materials for this purpose.

In the embodiment illustrated, each of the filters 26 and 26a is a monolithic ceramic structure of honeycomb configuration so as to provide parallel channels running the length thereof. Alternate cell channel openings on the monolith face are blocked in a checkerboard-type fashion, and the opposite end is blocked in a similar manner but displaced by one cell. With this arrangement the exhaust gas cannot flow directly through a given channel but is forced to flow through the separating porous wall into an adjacent channel. The exhaust gas is thus filtered as it flow through the porous wall between adjacent channels.

Now in accordance with a feature of the invention, a secondary duct 30 has its outlet end connected to the inlet 15 of the valve 14. In the construction shown in FIG. 1 the secondary duct 30, at its opposite end, supports a suitable heater means, which in the embodiment shown includes an air-fuel mixing and atomizing burner assembly 31 which is capable of supplying an atomized combustible air-fuel mixture to the interior of the secondary duct 30. A suitable electric igniter 32, such as a spark plug or glow plug, is also operatively mounted to the secondary duct 30 for igniting the air-fuel mixture supplied by the burner assembly 31.

Additional oxygen necessary to support combustion of the particulates on a filter is supplied by the controlled flow of exhaust gases to the filter. For this purpose a secondary exhaust passage 33 has one end thereof connected for flow communication with the secondary duct 30 while its opposite end is connected to a suitable constant flow regulator 34. The inlet of this constant flow regulator 34 in turn is connected by an exhaust passage 33a to the exhaust passage 10 upstream of the four-way valve 14. With this arrangement a controlled flow of exhaust gases can be supplied via duct 30 to an inactive filter to effect the controlled combustion of particulates trapped thereon.

In addition to the operational control of the vacuum actuator 21, the electronic control means, not shown, can also be used to control the operation of both the burner assembly 31 and of the electric igniter 32. For this purpose, the electronic control means, not shown, would in a conventional manner receive signals of various engines operating conditions and, in addition, would preferably also receive suitable signals indicating the pressure differential existing across each of the filters 26 and 26a during engine operation. This is accomplished by means of suitable pressure differential gauges 35 and 35a that are operatively connected for communication with both the inlet and outlet sides of the filters 26 and 26a, respectively, so as to measure the pressure drop across the respective filter.

Figure 2:
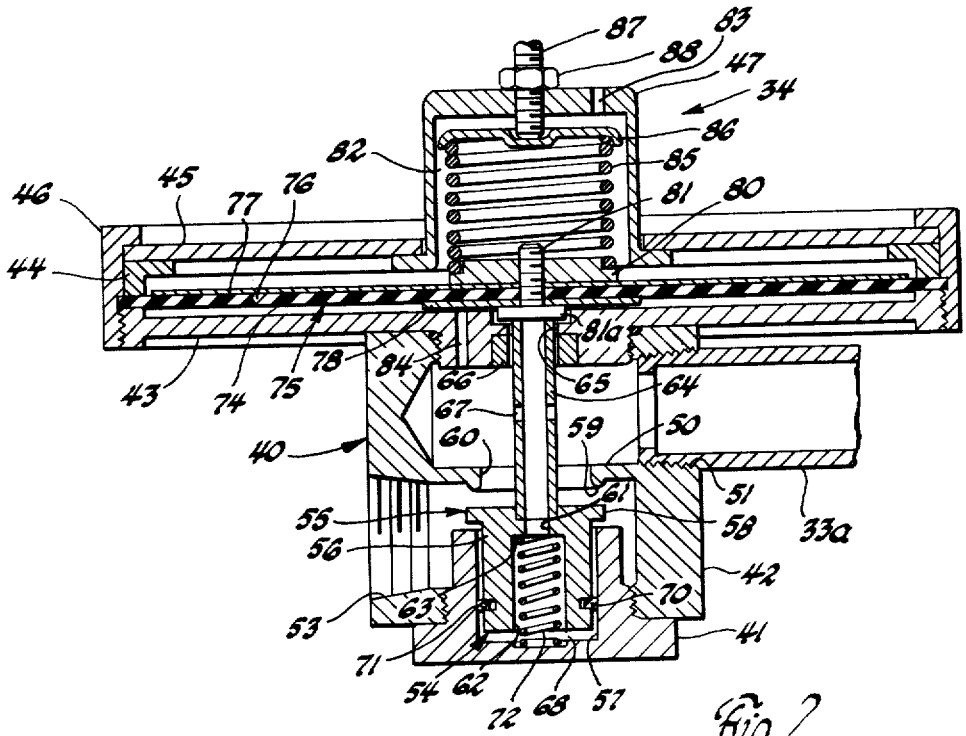
FIG. 2 is a longitudinal cross-sectional view of a suitable embodiment of a constant flow regulator, per se, for use with exhaust gases in the system of FIG. 1.

Referring again to the constant flow regulator 34, although any suitable regulator may be used, an exemplary embodiment of such a constant flow regulator that is adapted for use in controlling the flow of hot exhaust gases is shown in FIG. 2. Thus in the embodiment of the constant flow regulator illustrated in FIG. 2, this regulator 34 includes a regulator housing 40, which for ease of assembly of the elements housed thereby is a multipiece housing which includes, starting from the bottom with reference to FIG. 2, a lower cup-shaped closure cap 41, a hollow tubular body 42, a lower clamp disc 43, a circular spacer ring 44, an upper clamp disc 45, a clamp ring 46 and, an upper inverted cup-shaped cap 47, with these elements of the housing being suitably secured together into a unitary housing structure.

The body 42, having an axial stepped bore therethrough, is provided with a radial inlet port 50 having one end of the exhaust passage 33a, from exhaust passage 10, in flow communication therewith, as for example, by having a threaded interconnection as at 51 between these elements. In addition body 42 is also provided with a radial discharge port 53 for flow communication via exhaust passage 33 to the secondary duct 30. Flow from the inlet port 50 to the discharge port 53 is controlled by means of a piston valve, generally designated 54, to be described in detail hereinafter, and which, in the construction illustrated, includes a valve member 55 and valve rod 64.

Valve member 55 is of stepped external cylindrical configuration so as to provide a piston portion 56 that is reciprocably received in the internal blind bore wall 57 provided in cap 41 and an enlarged diameter upper valve portion 58 adapted to cooperate with an annular valve seat 59 encircling an internal passage 60 in body 42 so as to define therewith a variable area flow passage for the fluid flow from inlet port 51 to outlet port 53.

Valve member 55 is also provided with a stepped bore therethrough to define an internal stepped upper wall 61 and a lower internal wall 62 of a larger diameter relative to the diameter of wall 61. Walls 61 and 62 are interconnected by a flat shoulder 63.

The valve rod 64, in the construction shown in FIG. 2, is of hollow tubular configuration and is suitably fixed at its lower end as by a press fit into the enlarged diameter portion of bore 61 in valve member 55 so as to extend co-axially upward from this member. The valve rod 64 thus slidably extends upward, through a guide bore 65 and seal insert 66 provided in the lower clamp disc 43, into a chamber 74 whereby it can be actuated by a diaphragm actuator 75 in a manner to be described.

Also as shown, the valve rod 64 is provided with one or more radial orifice passages 67 to provide for the flow communication of exhaust gas that flow through inlet port 50 into the chamber 68 defined by the lower end of valve member 55 and the internal wall 57 of cap 41. With this arrangement the exhaust gas forces acting on opposite sides of the valve member 55 are substantially balanced. In addition, a split seal ring 70 positioned in an annular groove 71 provided for this purpose in the valve member 55 is adapted to effect a sliding seal between the valve member 55 and the bore wall 56.

A valve spring 72, of predetermined force, is positioned in chamber 68 with one end thereof in abutment against shoulder 63 and its opposite end in abutment against the internal bottom wall of cap 41, is operative to normally bias the valve member 55 upward in an axial direction towards seating engagement in the valve seat 59.

The diaphragm actuator 75 includes a diaphragm 76 that has its outer peripheral edge surfaces sandwiched between the lower clamp disc 43 and the spacer ring 44. The cental portion of the diaphragm 76 together with an upper, enlarged diameter, diaphragm retainer 77 are sandwiched between a lower diaphragm retainer 78 and an upper spring retainer 80. These elements are suitably secured together as by having a screw 81 extending up through suitable apertures in the retainer 78 diaphragm and retainer 77 so as to be threadingly received in the spring retainer 80. With this arrangement the head 81*a* of the screw 81 is positioned for abutment against the upper free end of the valve rod 64 for actuation of the valve member 55.

The diaphragm 76 as thus assembled is operative to separate the chamber 74 from an upper atmospheric chamber 82 in communication with the atmosphere as by means of a passage 83 provided in the cup 47. As shown in FIG. 2, the chamber 74 is in communication with the incoming flow of exhaust gases by means of an orifice passage 84 that extends through the lower clamp disc 43 radially outward of the stepped guide bore 65 therethrough.

The diaphragm 76 is normally biased in a valve member 55 opening direction by means of a compression spring 85 that has one end thereof positioned to abut against the spring retainer 80 and its other end to abut against an adjustable upper spring retainer 86, the axial position is adjusted by means of an adjusting screw 87 threaded through the base of the cap 47. A lock nut 88 is threaded on the adjusting screw 87 for abutment against the upper exterior surface of the cap 47.

It will be appreciated that the force of the compression spring 85 is preselected so as to be sufficiently greater than the force of valve spring 72 whereby the piston valve 54 is normally biased in an axial direction to effect unseating on the valve member 55 relative to the valve seat 59 against the bias of spring 72. Accordingly, when the engine is not in operation valve member 55 would be moved to a fully open position relative to valve seat 59. However, during engine operation, as the effective pressure of the exhaust gas flowing into the chamber 74 increases sufficiently to overcome the biasing force of the compression spring 85 and the atmospheric pressure in the chamber 82, the diaphragm actuator 75 will be forced by the differential pressure to move upward, with reference to FIG. 2, which movement then allows the valve spring 72 to effect closing movement of the valve member 55. As will be apparent, the axial extent of this valve member 55 movement will vary as a function of exhaust pressure, which in turn will vary as a function of engine operation, so that regardless of engine operation, a substantially constant flow of exhaust gas is discharged into supply passage 30.

In operation, exhaust gases from the engine, not shown, are discharged into the system by the inlet end of exhaust duct 10. If the valve member 18 of the four-way valve 14 is positioned as shown in FIG. 1, the exhaust gas can then flow through the now active filter 26, the valve member 18 blocking direct flow of exhaust gas to the now inactive filter 26*a*. Within the active filter 26 carbon and other particulates are collected and then the thus clean exhaust gas passes out from the end of this filter 26, via discharge section 24, to the atmosphere. If desired, some of this clean exhaust gas may be recirculated back to the combustion chambers, not shown, of the engine in a known manner.

With the valve member 18 in the position referred to hereinabove, the filter 26*a* is, in effect, an inactive filter. Assuming that this inactive filter 26*a* contains carbon and other particulates previously collected, these particulates are then removed from this filter by incineration. The necessary heat to effect this incineration is obtained by means of the burner assembly 31 which supplies a combustible air-fuel mixture that is ignited by the electrical igniter 32, the operation of both of these last two elements being controlled as desired by the electronic control means. Of course, with the valve member 18 thus positioned, the secondary duct 30 is now in flow communication with the inactive filter 26*a*.

A portion of the exhaust gas flowing into the exhaust duct 10 is permitted to flow via the exhaust passage 33*a*, constant flow regulator 34 and the exhaust passage 33, into the secondary duct 30. This secondary flow of exhaust gas is then heated in the secondary duct 30 by the heater means and then it flows through the inactive filter 26*a* to effect the incineration of the particulates previously trapped thereon. Of course it should be noted that during all modes of system operation any secondary flow of exhaust gases to an inactive filter would be cleaned by that filter so that only clean exhaust gas will pass out from the outlet end of the filter for discharge via the associate discharge section into the atmosphere.

As will now be apparent, only a preselected quantity of the total exhaust flowing into the exhaust duct 10 is diverted as secondary exhaust gas flow, the major portion of the total exhaust gas, as discharged from the engine, flowing through the exhaust duct 10 to an active filter as controlled by valve member 18.

The size of the constant flow regulator 34 and, in particular, the size of the variable area flow passage defined between valve member 55 and valve seat 59 of the regulator are preselected, for a given engine/-cleaner system application, so as to provide for the desired constant preselected flow of exhaust gas whereby to effect the controlled incineration of particulates on a filter.

In a particular engine application, the exhaust gas discharged from the engine was approximately 50 CFM at engine idle and approximately 300 CFM at maximum flow. In an embodiment of a cleaner system for use with this engine, the regulator 34 and associate passages were sized so as to provide for approximately 10 CFM of secondary exhaust flow to the inactive filter, as supplied to a dirty filter, with this secondary flow then increasing to approximately 14.2 CFM for a clean filter.

Of course, in this system embodiment, the preselected pressure drop through a dirty filter was limited to be approximately 18" water (0.6498 psig) under a full exhaust flow condition and was 9" water (0.3249 psig) under a full exhaust flow condition through a clean filter. Thus this difference in the pressure drop between a dirty filter as compared to a clean filter accounts for the change in the secondary exhaust flow through a dirty filter as compared to a clean filter as controlled by a particular embodiment constant flow regulator 34. However, at any constant pressure drop across the filter, the regulator was operative so as to provide for a substantially constant secondary flow of exhaust gas independent of engine speed.

After a time interval sufficient to effect complete incineration of the particulates on the inactive filter 26*a*, as determined for example, by a predetermined decrease in the pressure drop across the inactive filter, the operation of the heating means is discontinued. Thereafter, or when the collection of particulates in the active filter 26 reaches a level that causes a predetermined undesired restriction to the passage of exhaust gas therethrough, the position of valve member 18 is changed so that filter 26*a* then becomes the active filter receiving the primary flow of exhaust gas and filter 26 becomes the inactive filter. Filter 26 is then cleaned by incineration of particulates in the manner described hereinabove.

Figure 3:
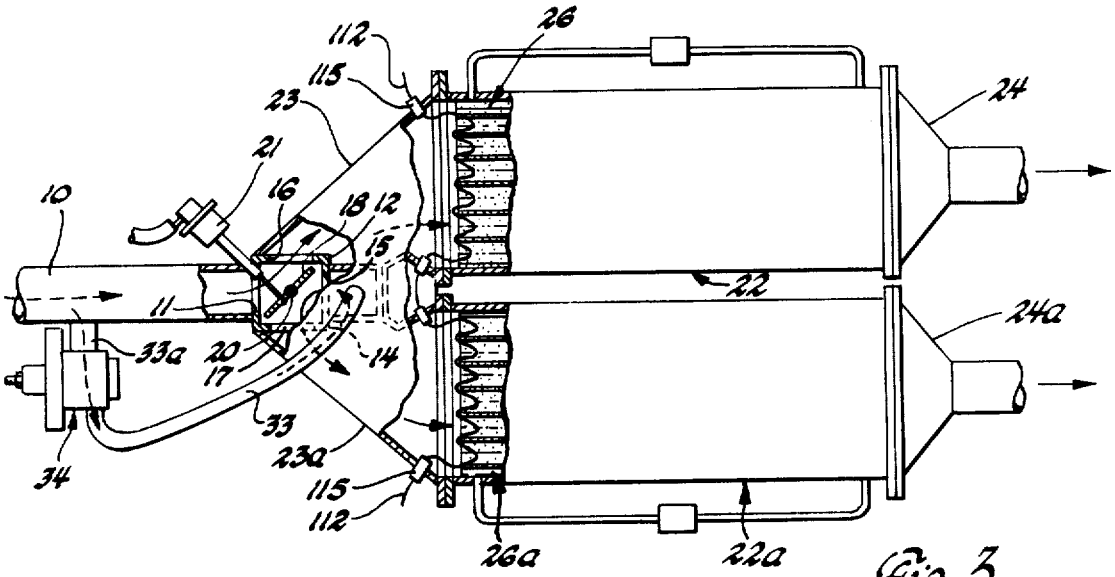
FIG. 3 is a schematic view of a second embodiment of a dual element exhaust cleaner and burner system in accordance with the invention.
Figure 4:
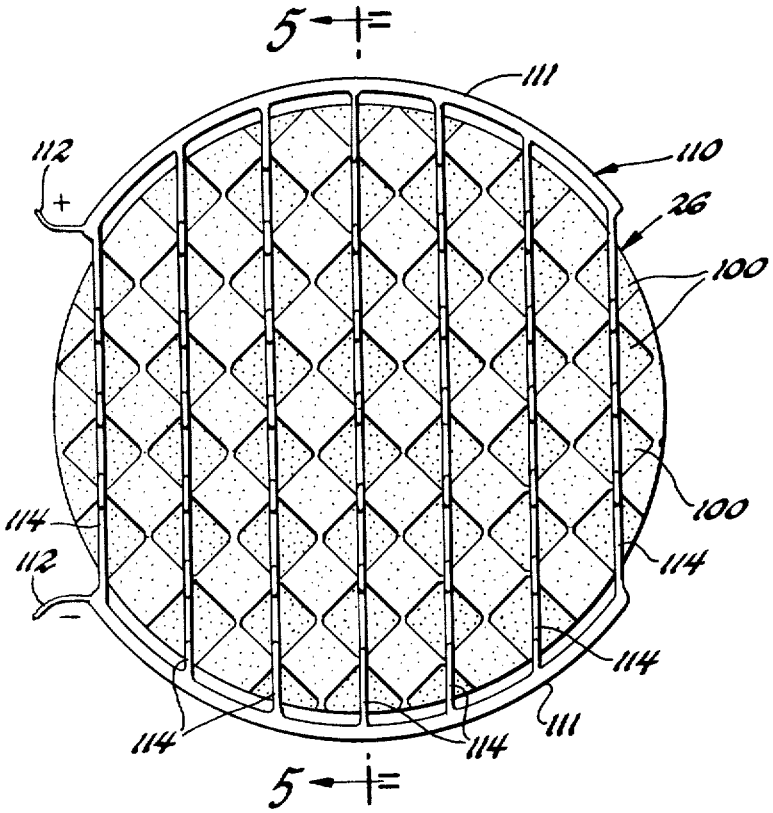
FIG. 4 is an enlarged end schematic view of an electric heater and associate filter trap, per se, of the system of FIG. 3; and, FIG. 5 is a cross-sectional schematic view taken along line 5—5 of FIG. 4 showing how the elements of the electric heater are positioned on and in the associate filter.
Figure 5:
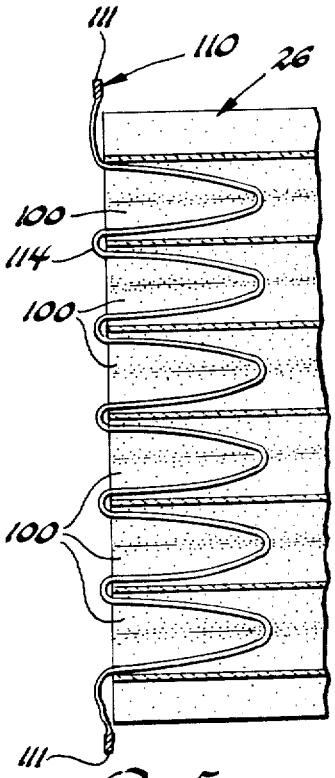

An alternate embodiment of a heater means, for use in a dual path exhaust cleaner and burner system constructed in accordance with the invention, is shown in FIGS. 3, 4 and 5, wherein similar parts are designated by similar numerals where appropriate.

As shown in FIG. 3, the cleaner portion of the system is structurally similar to that of FIG. 1, with the filters 26 and 26*a* thereof preferably being a monolithic ceramic type of honeycomb configuration defining parallel channels 100 running the length thereof, for a purpose to be described hereinafter. However, the heater means, used to heat the secondary exhaust flow to effect incineration of the particulates on the filters 26 and 26*a*, is in the form of a pair of electrical resistance heater elements, generally designated 110.

Preferably and as illustrated, a separate heater element 110 is operatively associated with each of the filters 26 and 26*a* so as to more rapidly raise the particulates trapped thereon to their combustion temperature.

Each heater element 110, in the construction illustrated, includes a pair of opposed arcuate shaped terminals 111 and interconnecting resistance wires 114. As shown, the terminals 111 are adapted to be connected as by associate electrical leads 112 to a source of electrical power, as controlled by an electronic control means, not shown, the leads 112 extending through suitable insulated bushings 115 provided for this purpose for example, in the intake end portions 26.

As schematically illustrated, each row of open channels on the inlet face of for example, the filter 26 has a resistance wire 114 extending thereacross from one lead 112 to the other lead 112, with the resistance wire bent at opposite sides of each channel opening and provided with a return bent portion that extends a predetermined distance into the channel, as best seen in FIG. 5. Preferably as illustrated in FIG. 4, the number of such resistance wires 114 correspond to the number of rows of open channels 110 on the filter's inlet face, taken, for example, either horizontally or vertically as shown in this Figure.

It will now be apparent that by using a monolithic ceramic type honeycomb filter, return bent portions of a resistance wire can be formed so as to project into the separate channels thereof, instead of merely being mounted on the inlet face of the filter or upstream thereof. With the arrangement shown, the heating area of the resistance wires are increased and they can be positioned more closely to those areas of the filter receiving the greatest deposit buildup of particulates whereby to more efficiently initiate heating and then the combustion of these particulates on the upstream side of the filter.

The operation of the exhaust cleaner and burner system of FIG. 3 is similar to that of FIG. 1 described hereinabove, except that the heater elements 110 would preferably be sequentially energized. That is only the heater element 110, associated with the inactive filter would be energized, as necessary, to effect incineration of the particulates trapped on that filter.

While the invention has been described with reference to the particular embodiments disclosed herein, it is not confined to the details set forth since it is apparent that various modifications can be made by those skilled in the art without departing from the scope of the invention. For example, although the operation of the exhaust cleaner and burner system has been described on the basis of the use of a two-position vacuum actuator 21, it will be apparent that a three-position vacuum actuator or that any other suitable type actuator can be used to control pivotable movement of the valve member 18.

Accordingly, this application is intended to cover such modifications or changes as may come within the purposes of the invention as defined by the following claims.

The embodiments of the invention in which an exclusive property or privilege is claimed are defined as follows:

1. A dual path exhaust cleaner and burner system for use with a diesel engine, said system including an exhaust passage for receiving spent combustion products exhausted from the engine; a four-way valve means having a first inlet connected to said exhaust passage, said valve means also having a second inlet opposite said first inlet and opposed first and second outlets with a movable valve for the selective control of flow from said first and second inlets to said first and second outlets; a secondary passage means connected to said second inlet; first and second housing means each having a gas inlet connected to said first and second outlets, respectively, and each having a gas outlet therefrom; first and second particulate trapping filter means of combustion resistant material operatively positioned in said first and second housing means, respectively; heating means operatively associated with said particulate trapping filter means to effect the incineration of particulates collected thereon during operation of the engine; and, a regulated flow exhaust passage means, including a constant flow valve means, connected at one end to said secondary passage means and connectable at its opposite end to said exhaust passage whereby a constant predetermined flow of exhaust gas, as controlled by said constant flow valve means, can be supplied to one of said particulate trapping filter means so as to effect a controlled complete incineration of particulates thereon.

2. A dual path regenerative particulate cleaner and burner system for use with a diesel engine; said system including a four-way valve means having opposed first and second inlets and opposed first and second outlets and a movable valve therein for the selective control of flow from said first and second inlets to said first and second outlets; said first inlet being connected to an exhaust duct adapted to be connected to the engine for receiving exhaust gas discharged therefrom; a secondary passage means connected to said second inlet; first and second housing means each having a gas inlet connected to said first and second outlets, respectively, and each having a gas outlet therefrom; first and second particulate filter means of combustion resistant material operatively positioned in said first and second housing means, respectively; heating means operatively associated with said secondary passage means for the supply of heat to raise the particulates collected on said filter means during operation of the engine to their combustion temperatures; and, a secondary exhaust passage means, including a constant flow regulator, connected at one end to said secondary passage means and connectable at its opposite end to said exhaust duct whereby a constant predetermined flow of exhaust gas, as controlled by said constant flow valve means, can be supplied to one of said particulate trapping filter means so as to effect a controlled complete incineration of particulates thereon.

3. A dual path exhaust cleaner and burner system for use on a diesel engine, said system including an exhaust passage means for receiving spent combustion products exhausted from the engine; a four-way valve means having opposed first and second inlets and opposed first and second outlets and a movable valve therein for the selective control of flow from said first and second inlets to said first and second outlets; said first inlet being connected to one end of said exhaust passage means; a secondary passage means connected to said second inlet; first and second housing means each having a gas inlet connected to said first and second outlets, respectively, and each having a gas outlet therefrom; first and second particulate trapping filter means of combustion resistant material operatively positioned in said first and second housing means, respectively; an electrical heating means operatively associated with each of said particulate filter means to effect the incineration of particulates collected thereon during operation of the engine; and, a regulated flow exhaust passage means, including a constant flow valve means, connected at one end to said secondary passage means and connectable at its opposite end to the exhaust passage means upstream, in terms of exhaust flow, of said valve means whereby a constant predetermined flow of exhaust gas, is supplied to one of said particulate filter means independent of engine speed.

* * * * *